US005988523A

United States Patent [19]

Scott

[11] Patent Number: 5,988,523

[45] Date of Patent: Nov. 23, 1999

[54] POP-UP SPRINKLER UNIT WITH SPLIT CONTAINMENT RING

[75] Inventor: Loren W. Scott, Carlsbad, Calif.

[73] Assignee: Hunter Industries, Inc., San Marcos, Calif.

[21] Appl. No.: 09/031,114

[22] Filed: Feb. 26, 1998

[51] Int. Cl.[6] ..... B05B 1/28

[52] U.S. Cl. ..... 239/114; 239/115; 239/205; 239/288.3

[58] Field of Search ..... 239/200, 201, 239/203, 204, 205, 206, 288, 288.3, 288.5, 114, 115; 277/434, 435, 436

[56] References Cited

U.S. PATENT DOCUMENTS

| | | | |
|---|---|---|---|
| 2,807,511 | 9/1957 | Fleming | 277/221 |
| 4,449,721 | 5/1984 | Tsuge | 277/221 |
| 5,222,669 | 6/1993 | Lawson | 239/205 |
| 5,423,486 | 6/1995 | Hunter | 239/205 |
| 5,711,486 | 1/1998 | Clark et al. | 239/205 |
| 5,779,243 | 7/1998 | Hanlon | 277/216 |

*Primary Examiner*—Andres Kashnikow
*Assistant Examiner*—Jorge Bocanegra
*Attorney, Agent, or Firm*—Michael H. Jester

[57] ABSTRACT

A pop-up sprinkler unit includes an outer cylindrical fixed housing for subsurface mounting, with a riser reciprocally mounted in a central bore of the housing for extending up through a portion of the soil. A radially retractable and expandable resilient plastic containment ring is mounted at an outlet end of the housing and engages an annular inner shoulder of the housing for retaining a coil spring and the riser in the bore. The containment ring is split to enable expansion and retraction. It has a first height throughout a first portion of its circumference and a second lower height throughout a second portion of its circumference to enable overlap during insertion of the ring into the upper end of the fixed housing. This configuration eliminates a gap at the split when the ring is in its retaining position, thereby preventing debris from entering the bore of the housing and preventing complete extension and/or retraction of the riser.

25 Claims, 3 Drawing Sheets

POP-UP SPRINKLER UNIT WITH SPLIT CONTAINMENT RING

BACKGROUND OF THE INVENTION

The present invention relates to sprinkler units, and pertains particularly to an improved containment ring for pop-up sprinkler units.

Pop-up sprinkler units are widely used in both residential and commercial applications to irrigate lawns and shrubs. They typically include a riser that is axially retracted into a fixed outer cylindrical housing buried in the ground when not in use, and which extends from the outer housing to a position above the surface of the ground when water pressure is applied. The top of the riser is level with the ground when retracted. Seals inside the housing wipe the surface of the riser as it extends from, and retracts into, the housing.

In many applications of retractable sprinkler units, such as playing fields, golf courses and the like, it is important that the tops of the risers of the sprinkler units reliably retract to a position level with the surface of the playing field, so that they not become obstacles. However, the typical riser of a conventional retractable sprinkler unit frequently jams or sticks in a partially retracted position. This usually occurs when dirt and debris get between the seals and the surface of the retractable riser. This often results in the riser being stuck, i.e. it will not retract.

In a conventional pop-up sprinkler unit the riser and its retraction spring and seals are assembled into the fixed outer housing from the top. These components are typically retained in place by a plastic containment spring which snaps into an annular groove at the top of the fixed outer housing. The containment ring is split so that it can be compressed inward in diameter and inserted into the upper end of the bore of the fixed outer housing. The resilient ring is then allowed to expand to engage in the annular groove in the housing bore to retain the riser in the housing. The containment ring has a sufficient gap at its split to enable the ring to be compressed in diameter sufficiently to be inserted in the bore of the outer housing. When the containment ring expands into the annular groove, the vertical opposing faces or ends of the ring spread apart, leaving a gap which allows dirt and debris to enter the outer housing. The dirt and debris can work its way between the seals and riser. This can damage the seals and/or cause the riser to jam.

It is, therefore, desirable that an improved simple and effective containment ring be available to hold a riser inside the fixed outer housing of a pop-up sprinkler unit.

SUMMARY OF THE INVENTION

It is, therefore, the primary object of the present invention to provide an improved containment ring for a pop-up sprinkler unit.

In accordance with the present invention, a subsurface pop-up sprinkler unit comprising a fixed outer housing and an axially retractable riser is provided with a specially configured radially retractable and expandable containment ring. The ring is mounted at the outlet end of the housing and engages an annular shoulder for retaining a spring and the riser in a bore of the housing. The containment ring is split to enable its radial expansion and retraction. It has a first height throughout a first portion of its circumference and a second lower height throughout a second portion of its circumference to enable overlap of the first and second portions during insertion of the ring. This eliminates a gap at the split when the ring is in its expanded retaining position.

BRIEF DESCRIPTION OF THE DRAWINGS

The above and other object and advantages of the present invention will become apparent from the following description when read in conjunction with the accompanying drawings wherein.

DETAILED DESCRIPTION OF THE PREFERRED EMBODIMENT

Figure 1:
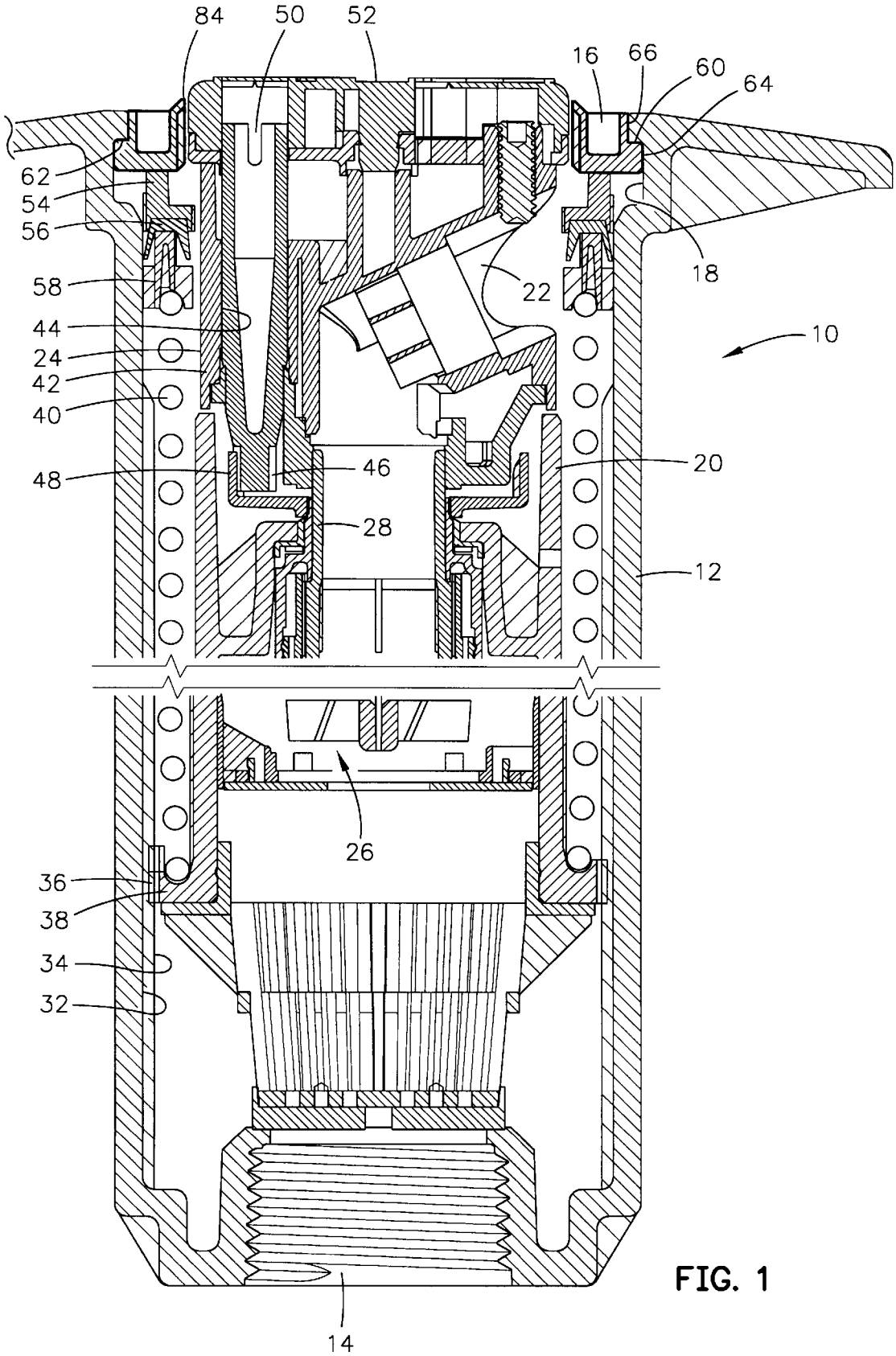
FIG. 1 is a vertical sectional view, illustrating a pop-up sprinkler unit including a preferred embodiment of a split containment ring in accordance with the present invention.

Referring to FIG. 1 of the drawings, there is illustrated a pop-up sprinkler unit 10 having a containment ring 16 constructed in accordance with a preferred embodiment of the present invention. The sprinkler unit 10 is shown in FIG. 1 with its riser 20 in its retracted position. Unless otherwise indicated, the sprinkler unit 10 is made of injection molded plastic parts. The sprinkler unit 10 comprises a generally cylindrical fixed outer housing 12, having an inlet opening or end 14 threaded for connection to the end of a fitting or pipe (not illustrated) coupled to a source of pressurized water (not illustrated). An upper outlet end of the outer housing 12 is provided with the containment ring 16 in accordance with the present invention. The ring 16 is detachably mounted in the housing 12 by means of an annular groove or recess 18 for retaining the retractably mounted cylindrical riser 20.

The riser 20 (FIG. 1) is mounted in the outer housing 12 for vertical reciprocal movement along the central axis of the cylindrical outer housing 12. The riser 20 includes a nozzle 22 in an upper or outer end thereof. The nozzle 22 is mounted in a rotatable head 24 and driven by means of a turbine 26. A reduction gear drive train (not illustrated) permits the turbine 26 to rotate a large hollow shaft 28 that turns the head 24, as is well known in the art. The sprinkler unit 10 may have a drive train designed to continuously rotate the head 24 about the central axis of the outer housing 12, or it may be designed to oscillate. In the later case, the sprinkler unit 10 is provided with arc adjustment means for alternate rotation of the head 24 through selectively adjustable arcs.

The head 24 (FIG. 1) is mounted for rotation on the upper end of the hollow tubular shaft 28 through which water flows to the nozzle 22. The head 24 is also mounted for selective rotation relative to the shaft 28 about its vertical axis in order to orient the direction of the nozzle 22 relative to the shaft 28. A rotatable shaft 42 is mounted in a bore 44 in the head 24 and carries a pinion gear 46 which drivingly engages a ring gear 48 on the shaft 28. The shaft 42 includes a tool slot 50 at the top of the sprinkler unit 10 for receiving a screw driver for rotating it. An elastomeric cap 52 protectively covers the entire top of the sprinkler unit 10 with a self-closing opening that provides access to the tool slot 50.

The riser 20 (FIG. 1) is reciprocally mounted within a large interior bore 32 of the outer housing 12. The riser 20 is oriented about its central vertical axis by internal ribs 34 and by means of teeth 36 on a radial flange 38 at the lower end thereof. An elongated retracting coil-type compression spring 40 engages a shoulder or flange 38 at the lower end of riser 20. The spring 40 is confined within the bore 32 of housing 12 by means of the containment ring 16 at the upper end. The spring 40 is compressed for normally biasing the riser 20 to its lowermost or retracted position as shown in FIG. 1 wherein the sprinkler head 24 is fully retracted within the outer housing 12.

The riser 20 (FIG. 1) with its retraction spring 40 is inserted into the bore 32 from the top of the housing 12. The containment ring 16 is engaged into the annular groove 18 formed in the interior wall at the upper end of the housing 12. A seal assembly is disposed between the containment ring 16 and the upper end of retraction spring 40. The seal assembly includes an upper ring 54 engaging the bottom of the containment ring 16 and a lip seal 56. The seal 56 sits on tip of a seating ring 58 that holds the upper end of the retraction spring 40.

The containment ring 16 (FIG. 2) is formed with a stepped outer peripheral surface forming a shoulder 60 (FIGS. 1 and 2) which engages an annular shoulder 62 (FIG. 1) formed by the upper portion of the groove 18 in the outer housing 12. The annular shoulder 60 is formed between a first outer diameter surface 64 and a second inner diameter surface 66.

Figure 2:
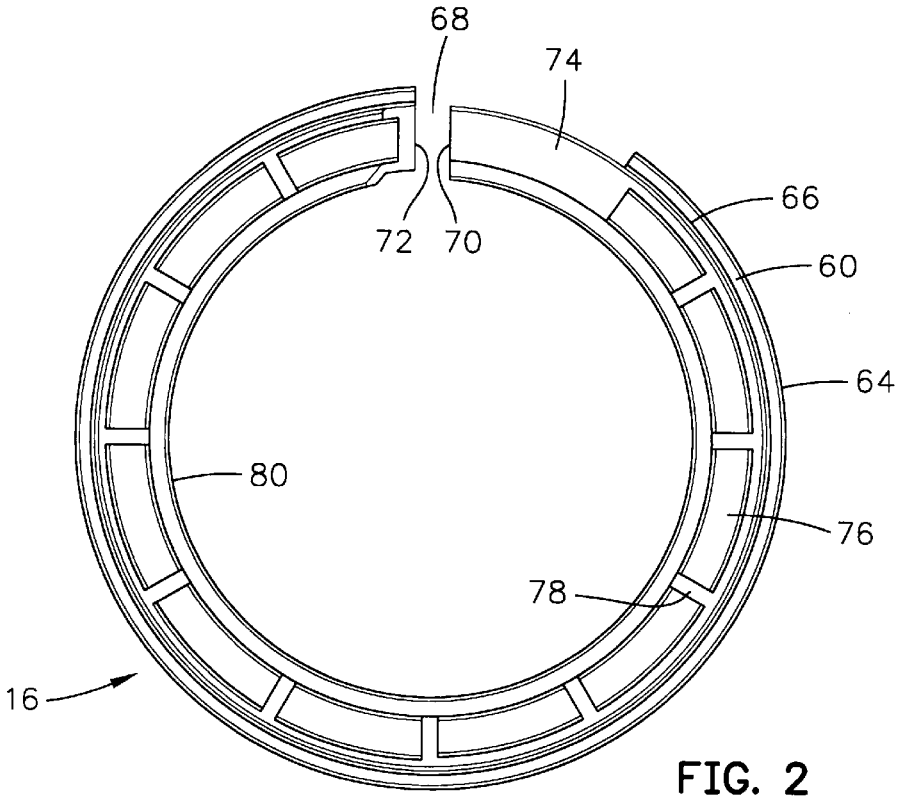
FIG. 2 is a top plan view of the containment ring of FIG. 1.
Figure 3:
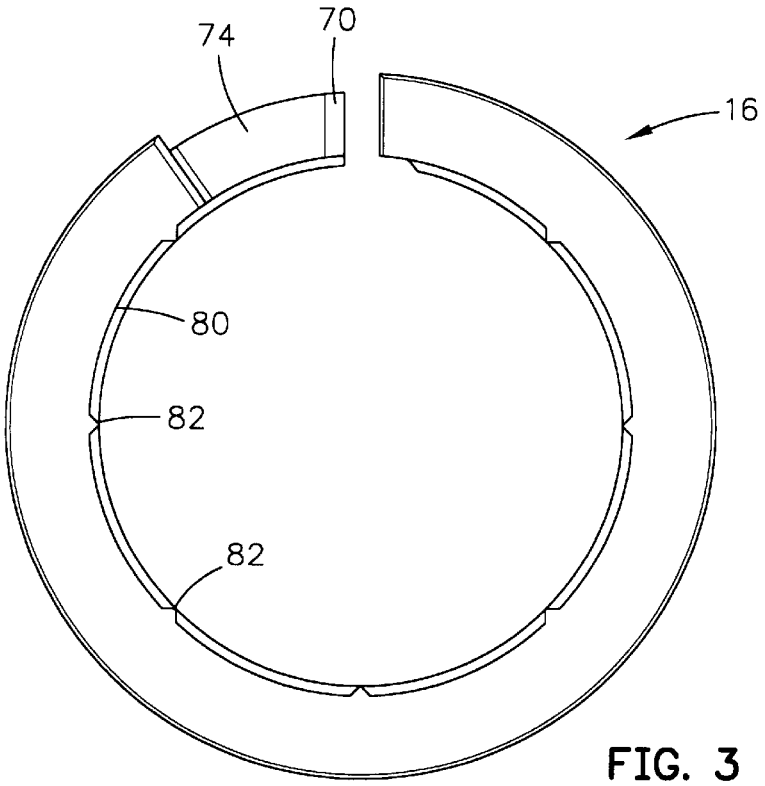
FIG. 3 is a plan view from the bottom of the containment ring of FIG. 2.

Referring to FIGS. 2 and 3, the illustrated containment ring 16 comprises a radially retractable and expandable split circular member adapted for mounting at the outlet end of the sprinkler housing 12. The containment ring 16 engages the annular shoulder 62 of the outer housing 12 for retaining the retraction spring 40 and the riser 20 in the bore 32. A split 68 in the containment ring 16 forms a slight gap at 68 between the ends to enable the ends to overlap and the ring 16 to be compressed. This overlap of the ends reduces the diameter of the ring 16 and allows it to fit into the upper end of the housing 12 and then to expand to engage the groove 18 in the upper end of housing 12. The spring-like property or resilience of the containment ring 16 is attributable to its rigid plastic construction.

Figure 4:
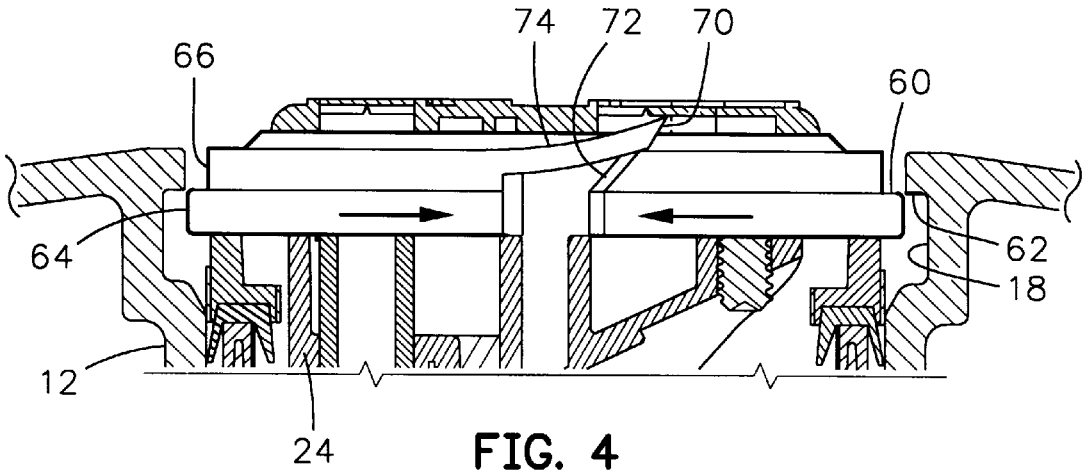
FIG. 4 is a view similar to the top portion of FIG. 1 showing the containment ring in elevation being installed.

The containment ring 16 as illustrated (FIGS. 2 and 3) is constructed to have a first height or vertical thickness throughout a first major portion of the circumference thereof and a second lower height or vertical thickness throughout a second and minor portion 74 adjacent the split 68. This height differential enables the minor portion 74 to overlap onto the major portion during insertion of said ring as illustrated in FIG. 4. The minor portion 74 is formed in the upper reduced outer diameter portion of the ring 16 and may also be considered a tab. The ring 16 is split at 68 to form spaced ends 70 and 72 that enable expansion and retraction of the overall outer diameter of the ring 16. This facilitates insertion and removal of the ring 16 from the housing 12.

Figure 5:
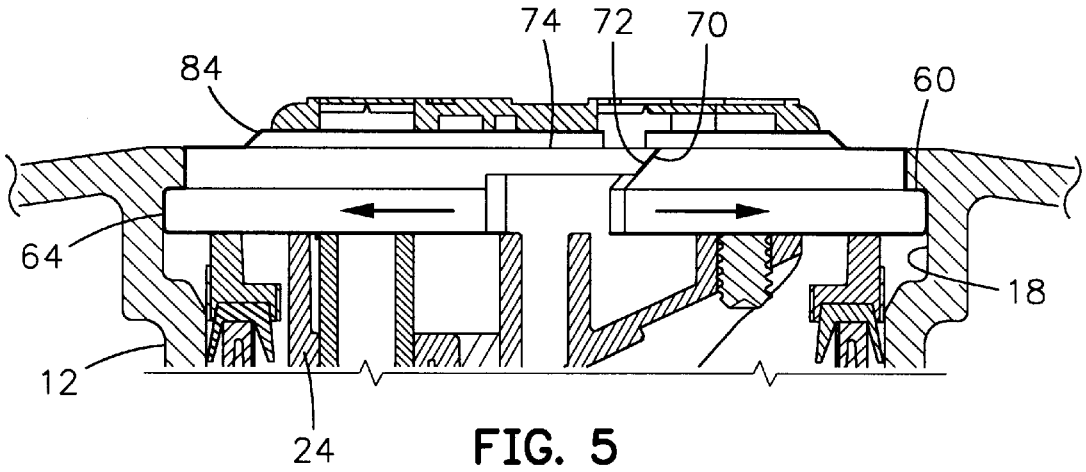
FIG. 5 is a view similar to FIG. 4 showing the containment ring after it has been fully installed.

The ends 70 and 72 are sloped or chamfered at the same angle so that they engage and close the ring 16 when fully installed (FIG. 5) to reduce and/or prevent the passage of dirt and debris down into the housing 12 around the riser 20. The angle of the terminal opposing ends 70 and 72 of the ring 16, while illustrated to be about forty-five degrees, may be any suitable angle such as from about thirty to about sixty degrees. The angled ends 70 and 72 function as a cam to enable the tab 74 to cam up and ride over the other end 72 for ease of installation and removal as best seen in FIG. 4. The tab 74 will slide down to a position in which the end 70 engages the other end 72 of the ring as best seen in FIG. 5 to eliminate a gap at the split 68 when the ring 16 is installed in its retaining position. It is apparent that the ends of the ring need not be angled, but may be straight across so long as the ends substantially abut when the ring expands in place.

The ring 16 (FIGS. 2 and 3) is preferably injection molded with circumferentially spaced recesses 76 (FIG. 2) separated with radial stiffening ribs 78 to reduce the amount of material and yet maintain strength and necessary rigidity. The recesses 76 also provide convenient receptacles for the teeth of a pliers-like tool that may be used to squeeze together the opposite sides of the ring 16. The ring 16 is also injection molded with an inner generally cylindrical wall 80 having circumferentially spaced stand off ribs 82 which normally engage and laterally support the riser 20. The ring 16 also has an upwardly directed inner circular edge 84 (FIG. 5) on its top which acts as a grit scraper to scrape larger particles of dirt and debris from the outer surface of the riser 20.

When it is desired to remove the containment ring 16, it is squeezed to reduce its diameter (as shown by the arrows in FIG. 4) until the tab 74 rides up on the end 72 so that shoulder 60 on the ring clears shoulder 62 of the housing. Once the retaining ring 16 is removed, the riser 20 can be removed from the upper end of the housing 12.

While the present invention has been illustrated and described by means of a specific embodiment, it is to be understood that numerous changes and modifications can be made therein without departing from the spirit and scope of the invention.

What is claimed is:

1. A pop-up sprinkler unit, comprising:

an elongated housing having a cylindrical bore with an inlet end for connecting to a source of water to an outlet end for receiving a retractable riser;

an elongated riser reciprocally mounted in said bore and movable between a retracted position within said bore and an extended position, said riser being responsive to a source of pressurized water for moving to said extended position in said bore;

spring means for normally biasing said riser to said retracted position;

an annular shoulder at said outlet end of said cylindrical bore; and a radially retractable and expandable containment ring mounted at said outlet end and engaging said annular shoulder for retaining said spring means and said riser in said bore, said containment ring being split to define opposite ends and to enable expansion and retraction, and said containment ring having a first height throughout a first portion of a circumference thereof and a reduced height throughout a second portion of the circumference adjacent said split to enable overlap of said first and second portions during insertion of said ring and to eliminate a gap at said split when said ring is in a radially expanded retaining position.

2. A sprinkler unit according to claim 1 wherein said reduced height is about one half said first height of said containment ring.

3. A sprinkler unit according to claim 2 wherein said containment ring has a stepped outer diameter.

4. A sprinkler unit according to claim 3 wherein said containment ring is formed with inner and outer vertically extending peripheral walls extending upwardly from a common base.

5. A sprinkler unit according to claim 4 wherein said inner peripheral wall has an inwardly extending upper edge defining a grit scraper.

6. A sprinkler unit according to claim 5 wherein said inner peripheral wall has ribs on an inner surface thereof which extend substantially parallel to a central axis of the housing.

7. A sprinkler unit according to claim 1 wherein said opposite ends are in engagement when said containment ring is installed.

8. A sprinkler unit according to claim 7 wherein said opposite ends are chamfered at a common angle.

9. A sprinkler unit according to claim 8 wherein said common angle is between about thirty degrees and about sixty degrees.

10. A sprinkler unit according to claim 9 wherein said common angle is about forty five degrees.

11. A pop-up sprinkler unit for mounting in a subsurface location, comprising:

an elongated fixed outer housing having a cylindrical interior bore extending from an inlet end for connecting to a source of pressurized water to an outlet end for receiving a retractable riser;

an elongated riser having an inner end and an outer end and a nozzle mounted on said outer end, the riser being reciprocally mounted in said bore and movable between a retracted position within said bore and an extended position within said bore wherein said outer end of said riser and said nozzle are extended from said outlet end of said housing, and said riser being responsive to the source of pressurized water for extending said riser to said extended position within said bore;

a compression spring mounted in the housing for normally biasing said riser to said retracted position;

an annular shoulder at said outlet end of said housing; and a radially retractable and expandable resilient containment ring mounted at said outlet end of said housing and engaging said shoulder for retaining said spring and said riser in said bore when seated in a retaining position, said containment ring having a stepped outer diameter defining a radial shoulder for engaging said annular shoulder of said housing, said containment ring being split to thereby define opposite ends and to enable expansion and retraction, and said containment ring having a tab at one end adjacent said split configured to enable overlap by said one end during radial retraction of said ring for insertion of said ring and to eliminate a gap at said split when said ring is permitted to expand to said retaining position.

12. A sprinkler unit according to claim 11 wherein said containment ring is formed with inner and outer vertically extending peripheral walls extending upwardly from a common base.

13. A sprinkler unit according to claim 12 wherein said containment ring has stepped outer peripheral walls.

14. A sprinkler unit according to claim 11 wherein said opposite ends are in abutting engagement when said containment ring is installed.

15. A sprinkler unit according to claim 11 wherein said opposite ends are disposed at a common angle.

16. A sprinkler unit according to claim 11 wherein said common angle is between about thirty degrees and about sixty degrees.

17. A sprinkler unit according to claim 16 wherein said common angle is about forty five degrees.

18. A containment ring for use in a pop-up sprinkler unit of the type having an elongated fixed housing having a cylindrical bore with an inlet end for connecting to a source of water and an outlet end for receiving a retractable riser, an inwardly facing shoulder at the outlet end of the housing, an elongated riser reciprocally mounted in the bore and movable between a retracted position and an extended position within said bore, the riser being responsive to a source of pressurized water for extending to said extended position, the containment ring comprising a radially retractable and expandable resilient ring for mounting at said outlet end of said housing and engaging said annular shoulder for retaining said riser in said bore, said ring being split to define opposite ends and enable expansion and retraction, and said ring having a first height throughout a first portion of a circumference thereof and a reduced height throughout a second portion of the circumference adjacent said split to enable overlap of said first and second portions during insertion of said ring and to eliminate a gap at said split when said ring is in an expanded retaining position.

19. A containment ring according to claim 18 wherein said ring has stepped outer peripheral walls, and said opposite ends are in abutting engagement when said ring is installed in said housing.

20. A containment ring according to claim 19 wherein said opposite ends are disposed at a common angle of between about thirty degrees and about sixty degrees.

21. A pop-up sprinkler unit for mounting in a subsurface location, comprising:

an elongated fixed outer housing having an interior bore and an inlet end for connecting to a source of pressurized water;

an elongated riser having an inner end and an outer end and a nozzle mounted on said outer end, the riser being reciprocally mounted in said bore and movable between a retracted position within said bore and an extended position within said bore wherein said outer end of said riser and said nozzle are extended from said outlet end of said housing, and said riser being responsive to the source of pressurized water for extending said riser to said extended position within said bore;

a spring mounted in the housing for biasing said riser to said retracted position;

an annular shoulder at said outlet end of said housing; and a radially retractable and expandable resilient containment ring mounted at said outlet end of said housing and engaging said shoulder for retaining said spring and said riser in said bore when seated in a retaining position, said containment ring having an outer diameter defining a radial shoulder for engaging said annular shoulder of said housing, said containment ring being split to thereby define opposing end portions and to enable radial expansion and retraction, and said opposing end portions being configured so that said opposing end portions can overlap during radial retraction of said ring for insertion of said ring and to substantially eliminate a gap at said split when said ring is permitted to expand to said retaining position.

22. A sprinkler unit according to claim 21 wherein said containment ring opposing end portions have chamfered opposing faces.

23. A sprinkler unit according to claim 21 wherein said containment ring opposing end portions have different vertical heights.

24. A sprinkler unit according to claim 22 wherein said opposite faces are in abutting engagement when said containment ring is expanded to said retaining position.

25. A sprinkler unit according to claim 22 wherein said opposing faces extend at a common angle.

* * * * *